US006464425B1

(12) United States Patent
Closkey

(10) Patent No.: US 6,464,425 B1
(45) Date of Patent: Oct. 15, 2002

(54) APPARATUS AND METHOD FOR MINIMIZING LIQUID INFILTRATION INTO SUBTERRANEAN OPENINGS

(76) Inventor: Robert F. Closkey, 90 Juniper Way, Basking Ridge, NJ (US) 07920

( * ) Notice: Subject to any disclaimer, the term of this patent is extended or adjusted under 35 U.S.C. 154(b) by 0 days.

(21) Appl. No.: 09/616,019

(22) Filed: Jul. 13, 2000

Related U.S. Application Data

(60) Provisional application No. 60/144,381, filed on Jul. 16, 1999.

(51) Int. Cl.[7] ..... E02D 29/14

(52) U.S. Cl. ..... 404/26; 404/25; 52/20; 95/45; 96/4; 454/48

(58) Field of Search ..... 404/25–26; 52/19–21; 95/45–46; 96/4, 6; 454/48

(56) References Cited

U.S. PATENT DOCUMENTS

| | | | | | |
|---|---|---|---|---|---|
| 3,631,654 | A | * | 1/1972 | Riely et al. | 96/6 |
| 3,712,009 | A | | 1/1973 | Campagna | 52/20 |
| 3,798,848 | A | | 3/1974 | Campagna | 52/20 |
| 3,969,847 | A | | 7/1976 | Campagna et al. | 52/1 |
| 3,973,856 | A | | 8/1976 | Gaglioti | 404/25 |
| 4,030,851 | A | | 6/1977 | Graybeal | 404/25 |
| 4,067,659 | A | | 1/1978 | Campagna, Jr. et al. | 404/25 |
| 4,101,236 | A | | 7/1978 | Meyer | 404/25 |
| 4,194,041 | A | * | 3/1980 | Gore et al. | 442/289 |
| 4,305,679 | A | | 12/1981 | Modi | 404/25 |
| 4,440,407 | A | | 4/1984 | Gagas | 277/212 F |
| 4,505,312 | A | * | 3/1985 | Lardner et al. | 141/326 |
| 4,512,492 | A | | 4/1985 | Graybeal | 220/204 |
| 4,597,692 | A | | 7/1986 | Gruenwald | 404/25 |
| 4,650,365 | A | | 3/1987 | Runnels | 404/25 |
| 4,763,449 | A | | 8/1988 | Vigneron et al. | 52/20 |
| 4,853,013 | A | * | 8/1989 | Rio et al. | 96/6 |
| 4,919,564 | A | | 4/1990 | Neathery et al. | 404/25 |
| 4,934,715 | A | | 6/1990 | Johnson | 277/205 |
| 4,957,389 | A | | 9/1990 | Neathery | 404/72 |
| 5,267,941 | A | * | 12/1993 | Snyders | 600/22 |
| 5,401,114 | A | * | 3/1995 | Guggemos | 404/25 |
| 5,509,715 | A | * | 4/1996 | Scharpf | 296/181 |
| 5,522,769 | A | * | 6/1996 | DeGuiseppi | 454/270 |
| 5,575,418 | A | * | 11/1996 | Wu et al. | 229/5.81 |
| 5,660,425 | A | * | 8/1997 | Weber | 296/163 |
| 5,951,200 | A | | 9/1999 | Barton | 404/25 |
| 5,957,618 | A | | 9/1999 | Sims et al. | 404/25 |

* cited by examiner

*Primary Examiner*—Heather Shackelford
*Assistant Examiner*—Sunil Singh
(74) *Attorney, Agent, or Firm*—Lerner, David, Littenberg, Krumholz & Mentlik, LLP

(57) ABSTRACT

Assemblies and methods are provided to divert liquids that would otherwise infiltrate utility manholes or other hatchways, while allowing gases to vent to the atmosphere. Preferred embodiments of the assemblies comprise a cover support frame, a sheet of water-repellent gas-permable material occluding the central opening of the support frame and a cover mated to the frame. Preferably, a stiffening ring or other means of providing structural rigidity to the venting structure is provided. The assemblies are lightweight and are simple to install, and can be fabricated from materials that are readily available. Moreover, the assemblies can be easily modified to accommodate field conditions.

23 Claims, 4 Drawing Sheets

APPARATUS AND METHOD FOR MINIMIZING LIQUID INFILTRATION INTO SUBTERRANEAN OPENINGS

CROSS REFERENCE TO RELATED APPLICATIONS

The present application claims benefit of United States Provisional Application No. 60/144,381, filed Jul. 16, 1999.

FIELD OF INVENTION

The present invention relates to apparatuses and methods to minimize the infiltration of liquids through hatchways, particularly utility manholes that provide entrance to subterranean chambers.

BACKGROUND OF INVENTION

According to information available in the environmental protection industry, the source of at least 35 percent of the inflow to sewage or wastewater treatment plants is rainwater or other non-wastewater liquid that has infiltrated the collection system. Reducing the amount of infiltrating water will reduce the volume demands imposed on these wastewater treatment plants and, thereby, decrease operating costs. Some wastewater authorities do not provide their own treatment, but pipe their wastewater to other facilities for processing. These authorities are charged monthly by the gallon of liquid piped and would immediately benefit by reducing the amount of rainwater or other non-wastewater infiltration. Private wastewater plants can realize the same benefits.

Other industries maintain extensive networks of equipment and wiring beneath the ground, for utilities such as electric, gas, fiber optic, telephone and cable services. These companies also desire to reduce the amount of rainwater infiltration to their utility vaults and thus of time and costs required to maintain manholes and vaults in dry and well-ventilated condition.

Most of the infiltrating liquid enters the above-mentioned systems through pick holes in manhole covers, which are perforations made through the cover to facilitate its removal and replacement using a pick or other tool. Some water also may enter between the cover and frame, especially if the assembly has become loose or worn.

Known systems for minimizing unwanted liquid infiltration include a variety of mechanical sealing devices, intended to prevent liquids from entering by these routes while allowing any gases that may be present to vent to the atmosphere. It has proved difficult to achieve both of these goals in a manner that would be cost-effective, where a large number of entry points are involved.

A common approach is to insert a polypropylene or metal bucket between the cover and the interior of the frame to capture and retain the infiltrated liquids. When filled to capacity, these buckets are difficult to remove because they are below the street level and may weigh over 20 pounds. Some devices also provide pressure-relief valves to vent the gases that would otherwise accumulate within the manhole, but the presence of these valves makes it still more difficult to open and close the manholes. U.S. Pat. No. 4,067,659 to Campagna, Jr. et al. discloses a bucket-like structure comprising a circular supporting flange that rests on the internal flange of a manhole cover support frame. A valve-member incorporated into the bucket relieves excessive gas pressure in the space beneath the bucket. Similar devices are disclosed in U.S. Pat. No. 4,650,365 to Runnels, U.S. Pat. No. 4,919,564 to Neathery et al., U.S. Pat. No. 4,957,389 to Neathery, U.S. Pat. No. 5,591,200 to Barton, and U.S. Pat. No. 5,957,618 to Sims et al. The later inventions are focused toward protecting the valves from damage and making the buckets easier to install and remove from the manhole. A similar approach is disclosed in U.S. Pat. No. 4,305,679 to Modi, which discloses the use of a plurality of expanding braces to compress an impermeable flexible membrane against the interior of the manhole frame. The resulting structure captures water flowing through the manhole cover and blocks water from entering the manhole through the joints between the frame and the manhole chimney. The braces must be compressed and removed from the frame to gain entry to the manhole.

Another approach is to install a closure plate to block the inflow of water. The use of a plate in place of a bucket reduces the amount of water collected beneath the cover. These devices typically include pressure relief valves to vent gases accumulating beneath the cover plate. The cover plates are designed to rest on an integral flange within the manhole frame. If no flange is present, a retaining ring or other suitable support structure must be installed. Devices of this type are disclosed in U.S. Pat. Nos. 3,712,009 and 3,798,848 to Campagna, U.S. Pat. No. 3,969,847 to Campagna et al., U.S. Pat. No. 3,973,856 to Gaglioti, and U.S. Pat. Nos. 4,030,851 and 4,512,492 to Graybeal.

Another approach is to provide an elastomeric seal between the contact surfaces of the cover and frame. The holes in the cover are filled to minimize infiltration or a cover without holes is used. The seal may be held in place by the weight of the cover or bolted securely to the frame. The main drawback of sealing the manhole in this manner is that the gases within the manhole chimney do not vent to the atmosphere and, therefore, may accumulate to hazardous levels. It is also more difficult to open and reseal the access opening. U.S. Pat. No. 4,763,449 to Vigneron et al. provides an elastomeric sealing ring interposed between the cover and an integral flange within the frame. A plurality of bolts and movable flanges recessed within the frame are used to hold the cover firmly against the sealing ring. These bolts and flanges must be loosened or removed to gain entry to the manhole. U.S. Pat. No. 4,934,715 to Johnson discloses the use of an elastomeric gasket to form a water-tight seal between a cover and frame. The circular groove must be formed within the frame to receive the gasket. The gasket is squeezed between the frame and cover using a plurality of bolts. U.S. Pat. No. 4,101,236 to Meyer provides a manhole cover with an O-ring groove and no perforations. The O-ring groove is positioned to allow an elastomeric O-ring to form a seal between the cover and the contact surface of a conventional manhole frame. U.S. Pat. No. 4,440,407 to Gagas discloses the use of an L-shaped elastomeric gasket to provide a seal between the contact surfaces of a manhole cover and frame. U.S. Pat. No. 4,597,692 to Gruenwald discloses the use of elastomeric gaskets and plugs to minimize inflow of water by forming a seal along the perimeter of the manhole cover and closing the perforations within the cover.

SUMMARY OF INVENTION

The present invention disclosed herein addresses the drawbacks of known devices and methods. One aspect of the present invention provides venting structures that utilize liquid-repellent, gas-permeable membranes to capture liquids that infiltrate manhole covers, while allowing gases to pass through the membranes. Certain preferred assemblies will also be useful to prevent particulate solids, such as sand or dirt, from penetrating between the cover and frame and causing them to bind together. The preferred assemblies are light-weight and simple to install and can be fabricated from materials that are widely available. The most preferred assemblies can be modified to accommodate field conditions.

In accordance with one embodiment of the present invention, there is provided an assembly that minimizes the infiltration of liquids into a manhole or other hatchway. The assembly comprises a venting structure that is installed between the manhole cover and frame. The venting structure, most preferably, utilizes a water-repellent gas-permeable fabric to contain or divert liquids that would otherwise enter the manhole through openings in the cover or between the cover and frame. The fabric allows gases and vapors that may exist in the manhole chimney to vent to the atmosphere.

In a preferred embodiment of the present invention, the assembly comprises a cover support frame; a sheet of water-repellent gas-permeable material covering the central opening of the support frame and preferably folded over a stiffening ring; and a cover mated to the frame. More preferably, additional sealing materials and/or packing elements are used to minimize movement of the cover in the frame and provide a non-wearing surface for the sheet of material, and to improve the liquid-tight seal between the cover and flange.

In another embodiment, the invention provides a venting structure for minimizing the infiltration of liquid into an access opening, such as a manhole or hatchway, while allowing gases to escape through the access opening. The venting structure comprises a sheet of liquid-repellent, gas-permeable membrane adapted to substantially occlude an opening in the venting structure. Preferably, the venting structure is adapted to be installed between the cover and the support frame that defines the access opening. The sheet may be adapted by cutting and folding portions of the sheet over a stiffening ring to provide structural support. The sheet may also be adapted by fluting its edges to form a dish-like structure conforming to the perimeter and underside of a provided cover.

In accordance with another aspect of the present invention, there is provided a method for minimizing infiltration of liquids into an access opening while allowing gases to escape through the access opening. Preferably, the method includes cleaning the surfaces of the frame and cover to remove dirt and other abrasive material; placing a venting structure over the access opening, partially overlapping the frame; and lowering the cover into place so that the venting structure is held in place between the cover and frame. More preferably, the method includes inspection of the assembly to determine that the cover is securely seated against the frame so that it does not move under normal traffic conditions and, if the frame is installed in the ground, that the cover is level with the top of the frame and grade. Most preferably, if the assembly is unsatisfactory, the method includes disassembling the assembly and providing a sealing element or packing material is placed along the rim of the frame to improve the fit between the cover and frame. Most preferably, the assembly process and inspection are repeated until the cover is securely seated against the frame.

DETAILED DESCRIPTION OF THE PREFERRED EMBODIMENTS

Figure 1:
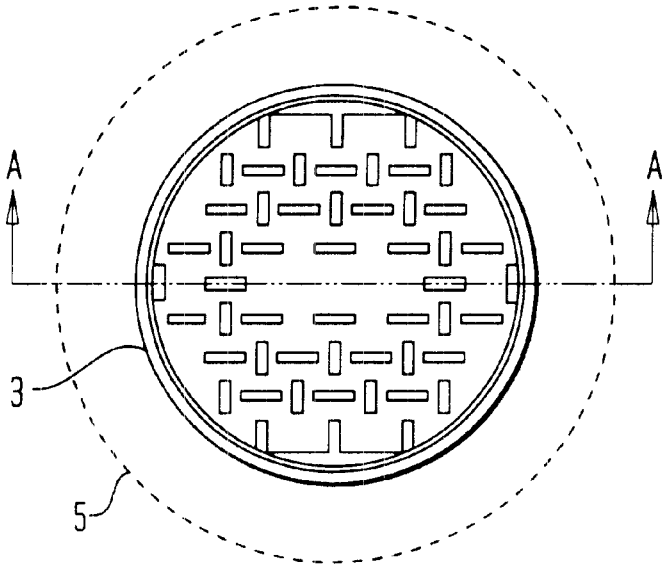
FIG. 1 (PRIOR ART)
FIG. 1 is a top plan view of a manhole frame and cover utilized with a preferred embodiment of the present invention.
Figure 2:
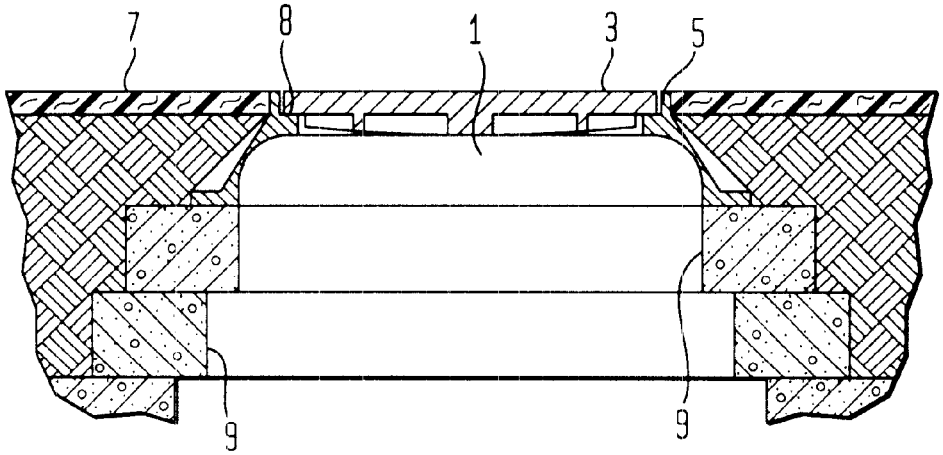
FIG. 2 is a side elevation view of the manhole frame and cover of FIG. 1.

The preferred embodiments of this invention are most suitable for use with conventional utility manholes as illustrated in FIG. 1 and FIG. 2. A typical manhole installation comprises a frame 5 over a manhole chimney 9, and a manhole cover 3. Frame 5 defines access opening 1 within frame 5. Frame 5 is typically installed in ground so that the top of frame 5 is conforms to the level of the surrounding grade 7. Cover 3 is mated to frame 5 so that cover 3 fits within frame 5 resting on the upwardly-facing surface of flange 8 and the top of cover 3 is level with surrounding grade 7.

Figure 3:
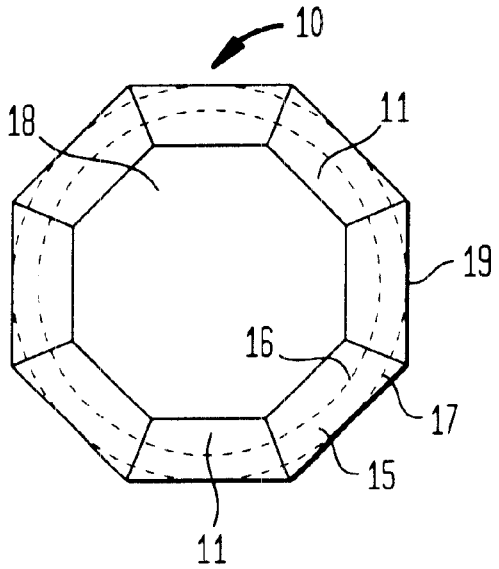
FIG. 3 is a bottom plan view of the venting structure of a preferred embodiment of the present invention.
Figure 4:
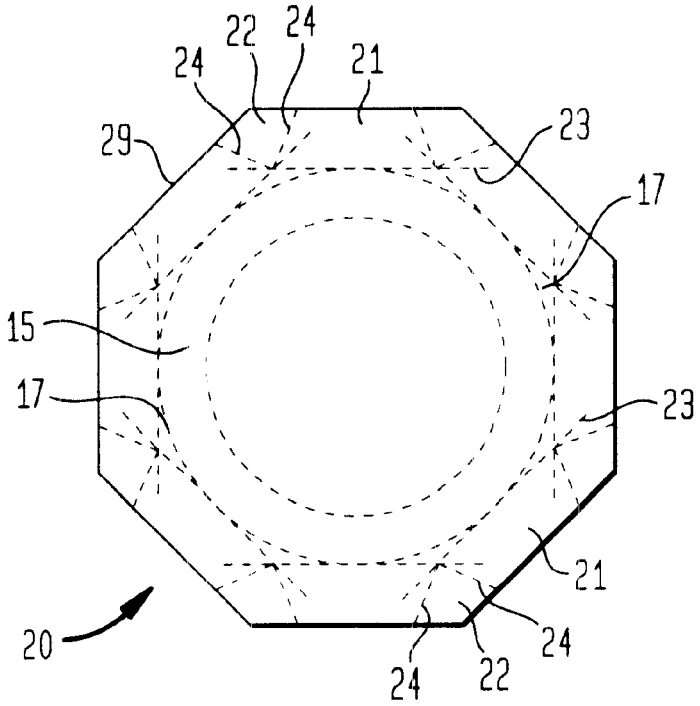
FIG. 4 is a bottom plan view of an unfolded sheet of liquid-repellent, gas-permeable material, showing cut marks and fold lines to form the venting structure of FIG. 3.

A venting structure 10 in accordance with a preferred embodiment of this invention is illustrated in FIG. 3. Venting structure 10 comprises a sheet 19 of water-repellent, gas-permeable material that has been adapted to occlude access opening 1 while overlapping flange 8. Where sheet 19 has only one water-repellent side, the side opposite the water-repellent side is designated, preferably, as the underside 18. Stiffening ring 15 comprises a central opening 16 and an outer edge 17 that is adapted to fit within frame 5, and preferably resting on flange 8. Stiffening ring 15 acts as a frame, providing structural support to venting structure 10. Preferably, stiffening ring 15 is adapted to fit snugly within frame 5 while resting on the upper surface of flange 8. More preferably, stiffening ring 15 is made of a compressible material so that it serves as a seal element when squeezed between cover 3 and flange 8. Edge portions 11 are folded over stiffening ring 15 and attached to underside 18 in the central portion of sheet 19 accessible through opening 16.

Assembly 20 comprises the components of venting structure 10. Sheet 29 of liquid-repellent, gas-permeable material is cut to the shape necessary to make the sheet 19 used in venting structure 10. The position of stiffening ring 15 is shown in outline. Edge portions 11 are formed by cutting away excess material 22 along cut lines 24 so that edge portions 11 do not overlap each other when folded to form venting structure 10. Folds are made along fold lines 23 near the outer edge 17 of stiffening ring 25.

As discussed further below, stiffening ring 15 merely needs to fit on flange 8 of frame 5. Edge portions 11 should be large enough to fold over stiffening ring 15 and tack to the underside 18 of sheet 19. Methods to determine the dimensions of assembly 20 with edge portions 11, excess material 22, and fold lines 23 will be apparent from the foregoing. Also, assembly 20 may be prepared with other shapes than illustrated. An eight-sided shape is shown for assembly 20 for simplicity of illustration. Circular shapes may be approximated more closely by increasing the number of edge portions 11. It will also be apparent that a functionally acceptable venting structure can be made by folding edge portions 11 onto the underside 18 of sheet 19 without cutting away excess material 22. If field conditions do not necessitate structural stiffness in venting structure 10, stiffening ring 15 may be omitted.

Edge portions 11 can be secured to underside 18 using starch, adhesives, or other tacky substances. For certain applications, securement of edge portions 11 can be temporary in nature, as it will be sufficient that they are held in position until cover 3 is seated on frame 5. Edge portions 11 then will be held in place by the weight of cover 3.

Preferably, the sheet of liquid-repellent, gas-permeable material used for venting structure 10 comprises composites or laminates of woven fabric and gas-permeable plastic membranes. More preferably, the gas-permeable plastic membranes will be made of a spun-bonded high-density polyethylene, spun-bonded polypropylene, spun-bonded polyester, spun-bonded polyacrylic, spun-bonded polyaramid, or an expanded polytetrafluoroethylene, and laminates and composites with one or more of the more preferable membranes or with a woven fabric. Other more preferable materials include woven fabrics, such as nylon, polyester, polyacrylic, polyaramid or blends thereof, which have been chemically treated to repel water. These materials can be adapted for use in this invention by mechanical means, such as folding or pleating, by heat-treatment, or by other means known to the art. Commercially available sheets comprise a range of thicknesses, tensile strengths, and other mechanical properties relevant to their use in venting structures of the types disclosed herein. Such sheets may be selected to provide the properties most preferred for particular applications and field conditions.

Figure 6:
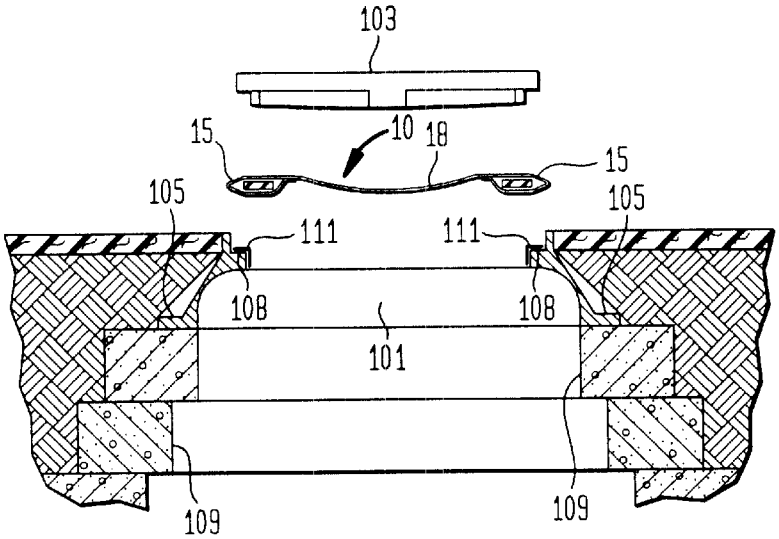
FIG. 6 is an exploded view showing the venting structure of FIG. 5 in relation to a manhole cover and frame.

Installation of venting structure 10 is illustrated in FIG. 6. Venting structure 10 is placed onto frame 105 so that stiffening ring 15 rests on flange 108 and venting structure 10 occludes access opening 101 as defined by frame 105. Venting structure 10 is installed, preferably, with a water-repellent side upward, that is, with underside 18 facing the manhole chimney 109, to take the fullest advantage of the water-repellent, gas-permeable properties of the material. Cover 103 is placed onto frame 105 so that stiffening ring 15 is squeezed between cover 103 and the upper surface of flange 108. Sealing element 111 may be interposed between venting structure 10 and flange 108.

The use of sealing element 111 is particularly preferred in embodiments of the venting structures that do not include stiffening rings. Sealing elements should be selected to improve the water-tight seal between the venting structure and flange and to reduce abrasion of the water-repellent, gas-permeable material where it contacts the flange. Preferably, a gasket with an "L"-shaped cross-section is used to obtain the desired water-tight seal. A sealing substance, such as a caulk of silicone or polyurethane composition, may be preferred depending on field conditions, especially if the cover or frame are old or worn. Alternative materials, such as oakum or packing materials known to the art, may be used to obtain the desired seal.

Figure 5:
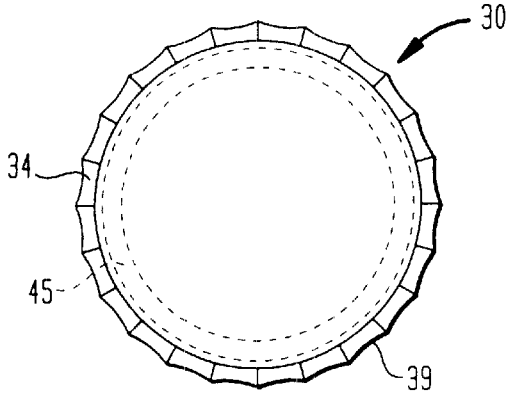
FIG. 5 is a top plan view of a sheet of liquid-repellent, gas-permeable material adapted for use as a venting structure in a preferred embodiment of the invention.

The assembly 30 for another preferred venting structure 40 is illustrated in FIG. 5. A sheet 39 of liquid-repellent, gas-permeable material is cut to a shape that will occlude access opening 1 and overlap flange 8 and the perimeter of cover 3. The position of stiffening ring 45 is shown in outline. Edge 34 of sheet 39 is fluted by pleating, heat treatment, or some other method known to the art.

Figure 7:
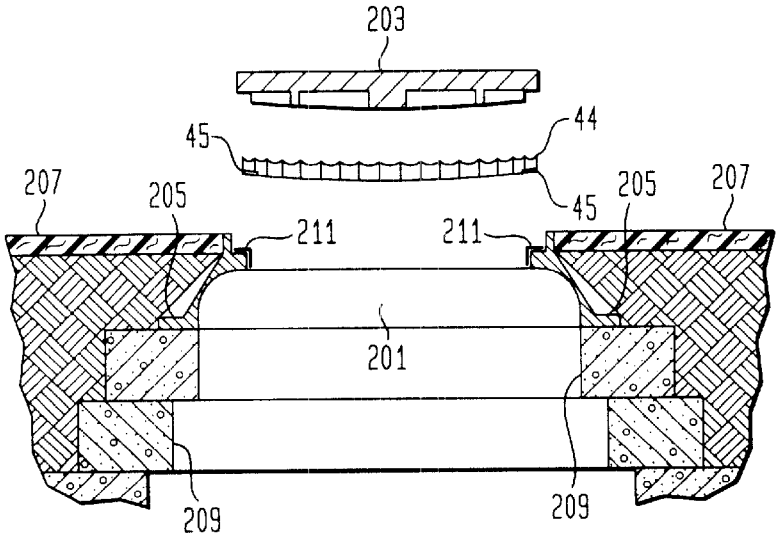
FIG. 7 is a fragmentary cross-sectional view on an enlarged scale depicting the cover and frame of FIG. 2 in conjunction with the venting structure of FIG. 3.
Figure 8:
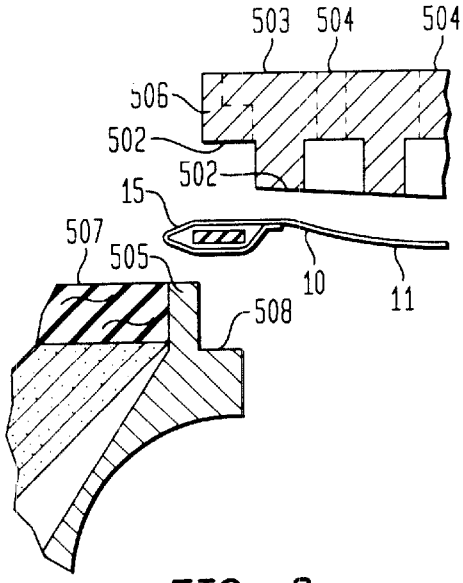
FIG. 8 is an exploded view showing the venting structure of FIG. 3 in relation to a manhole cover and frame.

Installation of venting structure 40 is illustrated in FIG. 7. Venting structure 40 is placed onto frame 205 so that stiffening ring 45 rests on flange 208 and venting structure 40 occludes access opening 201 as defined by frame 205. Similarly to venting structure 10, venting structure 40 is installed, preferably, with a water-repellent side upward, that is, with underside 47 facing the manhole chimney 209. Cover 203 is placed onto frame 205 so that stiffening ring 45 is squeezed between cover 203 and the upper surface of flange 208. The fluted edge 34 of assembly 30 folds upwardly to form sidewall 44 which substantially surrounds the vertically-oriented rim of cover 203. If sidewall 44 extends vertically-oriented rim of cover 203, excess sidewall material maybe folded onto surface grade 207 and secured to surface grade 207 by use of tar or other sealing material, providing additional protection against infiltration of liquids between frame 205 and venting structure 40. Cover 203 rests directly on stiffening ring 45. Sealing element 211 may be interposed between venting structure 40 and flange 208.

Certain liquid-repellent, gas-permeable materials can be shaped to form rigid structures through application of heat and mechanical deformation. Sidewall 44 can be created as a rigid structure by bending and pleating the fluted edge portion 34 of sheet 39 at the same time as the material is softened by application of heat. Folding or rolling the outer edge of sheet 39 at the same time that heat is applied will shape the outer edge of the sheet to form a rigid rim.

The venting structures 10 and 40 illustrate two of the preferred embodiments of the venting structure of this invention. These structures, and those of similar construction, may also be used to prevent infiltration of liquids into valve boxes and aboveground hatchways. Other embodiments will become obvious to those persons having ordinary skill in the art. For example, the venting structure of this invention may take the form of a bucket or plate having an opening occluded by a layer of water-repellent, gas-permeable material. Another variation entails installing the venting structure within the manhole chimney below the frame, rather than installing it within the frame as illustrated for venting structures 10 and 40.

In another aspect, the invention comprises a method for minimizing infiltration of liquids into the access opening of a manhole while allowing gases within the manhole chimney to escape to the atmosphere. In this method, manhole cover 503 is removed, and the top surface of flange 508 and bottom surface 502 of cover 503 are cleaned to remove dirt, corroded metal fragments, and other substances that would increase the wear on the fabric or interfere with formation of a close contact between the material and the frame. The venting structure 10 is then placed over frame 505 with stiffening ring 15 resting on flange 508. Manhole cover 503 is lowered onto frame 505 in such a manner that venting structure 10 is neither dislodged or damaged. Cover 503 is then inspected to determine that cover 503 fits securely within frame 505 so that cover 503 will not move under normal traffic and is level with the top of the frame 505 and surface grade 507. If cover 503 does not fit securely, cover 503 and venting structure 10 are removed from frame 505. Sealing element 511 is installed on flange 508 to improve the fit of cover 503 to frame 505. A gasket with an "L"-shaped cross-section is generally preferred for use as sealing element 511. A caulking substance or packing material may be preferred for use as sealing element 511 if the frame or cover are corroded or worn, or if other field conditions warrant their use. Venting structure 10 then is replaced onto flange 508 and cover 503 is lowered onto frame 505. If excess material from venting structure 10 protrudes above cover 503, it can be pushed into the space between cover 503 and frame 505, cut away, or secured to frame 505 or surface grade 507 with tar or some other suitable sealing material. Preferably, vent holes 504 are sealed, and pick hole 506 is left open to allow ventilation of the gases that pass through sheet 19.

Figure 9:
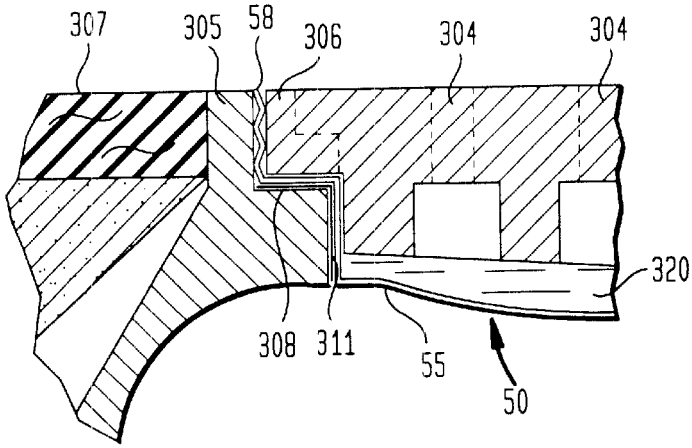
FIGS. 9 and 10 are fragmentary cross-sectional views on an enlarged scale of the assembly of FIG. 1, depicting a cover and frame in conjunction with the venting structures in accordance with certain embodiments of the invention.
Figure 10:
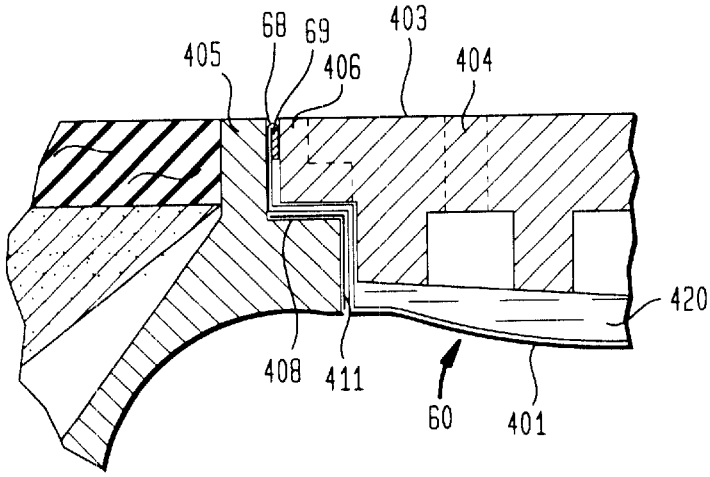

A completed installation is illustrated in FIG. 9. The edges of venting structure 50, a structure of the same general type as venting structure 10 and 40, are squeezed between cover 303 and the inner flange 308 of frame 305 forming a water tight seal. Stiffening ring 55 aids in forming this seal, as does sealing element 311. Liquid 320 that infiltrates cover 303 is captured and contained between cover 303 and venting structure 50 until liquid 320 evaporates. If the space between cover 303 and venting structure 50 is filled, additional amounts of liquid will be diverted, and will follow the grade 307 to an existing storm water collection system. The presence of excess material 58 between cover 303 and frame 305 does not interfere with opening and closing manholes of conventional design. The manhole is easier to open because excess material 58 blocks dirt from entering the spaces between the manhole frame and cover, which would otherwise cause those parts to bind to each other. It also will prevent metal-on-metal contacts from binding.

Installation of venting structures 10 and 40 may become difficult under windy conditions because of the light weight and relatively large surface area of this type of structure. Such conditions can be accommodated by removably securing the venting structure to the frame before lowering the cover onto the frame. Preferably, the venting structure is secured to the frame by applying an adhesive or other tacky substance to the frame and pressing the venting structure into place. Most preferably, the tacky substance is of a type that will the venting structure to be easily removed from the frame to obtain access to the manhole.

The conventional practice has been to replace manhole covers by inserting a tool through pick hole 306 and dragging the cover into position on frame 305. Using this method with installations such as those shown in FIGS. 6 and 7 creates a risk of damaging the venting structure if the cover is carelessly handled or rests loosely in the frame. Hoists and other machines have been used to lower covers onto frames where careful or accurate placement are needed, but such equipment can be cumbersome to move between manholes. Applicant has discovered that manhole covers can be carefully and accurately placed onto their frames using ribbons of the same materials used to make the venting structures. Two or more ribbons are cut from a sheet of water-proof, gas-permeable material having sufficient tensile strength for this purpose. The ribbons are laid onto a level surface and the manhole cover placed across the ribbons. Two persons can then lift the cover and carefully lower it into position on the frame using the ends of the ribbons as handles. After the cover is seated on its frame, the ribbon ends are cut away or secured to the surface grade. This method also allows careful placement of the cover and venting structure as a unit, providing another approach to installing venting structures under windy field conditions. The venting structure is secured to the cover, using a tacky substance, elastic bands, or some other suitable method, and the assembly is placed across the ribbons. The ribbons are then used as handles to lift the cover and venting structure as a unit and lower it into position.

A functional venting structure may be assembled in the field from a single sheet of water-repellent, gas-permeable material. In this method, the frame and cover are cleaned according to the method already described. The sheet of material 60 is placed across the access opening 401 defined by frame 405, after applying sealing elements 411, if needed, and the cover 403 is lowered into place so that sheet 60 remains smooth and flat on top of flange 408, and is held securely by the weight of cover 403. Alternatively, sheet 60 may be placed on a level surface, cover 403 placed on sheet 60, and sheet 60 and cover 403 positioned over frame 405 and lowered together onto frame 405 using the excess material of sheet 60 that extends around cover 403 as handles to manipulate sheet 60 and cover 403 together. The assembly is then inspected and the installation repeated as has been described. Excess material overlapping frame 405 then is folded back into the space between the cover 403 and frame 405, cut away or secured to frame 405 or surface grade 407 using tar or by some other suitable sealing material. Preferably, the excess material is folded over a loop 69 of material that fits snugly to the vertically extensive edge of cover 403 to form a double-layer 68 of material. Loop 69 may comprise wire, cord, elastic, or other element of similar shape. Loop 69 provides structural support to sheet 60 and aids in forming a seal between cover 403 and frame 405.

What is claimed is:

1. An assembly for minimizing infiltration of liquid into a utility manhole while allowing gases to escape through said manhole, said assembly comprising:

a manhole frame defining an access opening and comprising an integral flange within said access opening;

a venting structure comprising a sheet of liquid-repellent gas-permeable material, said venting structure occluding said access opening and forming a substantially liquid-tight seal with said manhole frame; and a manhole cover having a vertically-oriented rim, said manhole cover being mated to said manhole frame so that said manhole cover substantially covers said access opening when said manhole cover rests on said integral flange.

2. The assembly of claim 1, wherein a portion of said venting structure is squeezed between said manhole cover and said integral flange, thereby forming said liquid-tight seal.

3. The assembly of claim 1 wherein said sheet of liquid repellent, gas-permeable material is adapted to substantially cover said access opening and overlap a portion of said manhole frame.

4. The assembly of claim 3 wherein an edge of said sheet of liquid-repellent gas-permeable material is folded back upon itself to form a double-layer of material.

5. The assembly of claim 1 further comprising a loop sized to fit snugly around said vertically-oriented rim of said manhole cover, said sheet of liquid-repellent gas-permeable material being positioned between said loop and said vertically-oriented rim.

6. The assembly of claim 1 comprising a stiffening ring between said sheet of liquid-repellent, gas-permeable material and said manhole frame, wherein said stiffening ring comprises a central opening and an outer edge adapted to fit within said manhole frame.

7. The assembly of claim 1 wherein said assembly further comprises a sealing substance between said integral flange and said venting structure.

8. The assembly of claim 1 wherein said assembly further comprises a compressible seal element between said integral flange and said venting structure.

9. The assembly of claim 1 wherein said liquid-repellent gas-permeable material is a non-woven synthetic fabric selected from the group consisting of spun-bonded high-density polyethylene, spun-bonded polypropylene, spun-bonded polyester, spun-bonded polyacrylic, spun-bonded polyaramid, and expanded polytetrafluoroethylene fabrics, and laminates and composites thereof with other members of the group, and laminates and composites thereof with woven fabric.

10. The assembly of claim 1 wherein said liquid-repellent gas-permeable material is a water-proofed woven fabric selected from the group consisting of nylon, polyester, polyacrylic, polyaramid, and blends thereof.

11. The assembly of claim 1, wherein said access opening defined by said manhole frame is oriented horizontally.

12. The assembly of claim 11, wherein said manhole frame is installed within the ground so that said upper surface of said manhole frame substantially conforms to grade.

13. A method for minimizing infiltration of liquids into a utility manhole while allowing gases to escape through said manhole, comprising:

providing a manhole frame defining an access opening and comprising an integral flange within said access opening, and a manhole cover that substantially covers said access opening when said manhole cover rests on said integral flange, said manhole cover having a vertically-oriented rim;

placing a venting structure comprising a sheet of liquid-repellent gas-permeable material onto said manhole frame so that said venting structure occludes said access opening and forms a substantially liquid-tight seal with said manhole frame; and placing said manhole cover onto said integral flange.

14. The method of claim 13, further comprising removing dirt, corroded metal and other abrasive substances from portions of said manhole cover and manhole frame may contact said venting structure.

15. The method of claim 13 further comprising removably securing said venting structure to said manhole frame so that said venting structure remains secured to said manhole frame independently of said manhole cover.

16. The method of claim 13 wherein said sheet of liquid-repellent, gas-permeable material substantially occludes said access opening and overlaps a portion of said manhole frame.

17. The method of claim 16 further comprising a loop of material fitting snugly around said vertically-oriented rim of said cover and securing said sheet of liquid-repellent, gas-permeable material to said vertically-oriented rim.

18. The method of claim 17 further comprising folding said sheet of liquid-repellent gas-permeable material to form a double-layer of said sheet between said manhole cover and said manhole frame.

19. The method of claim 13 further comprising placing a seal element onto said integral flange where said seal element is selected from the group consisting of a compressible seal element, a packing material, and a caulking material.

20. The method of claim 13 wherein placing a venting structure comprising a sheet of liquid-repellent gas-permeable material onto said manhole frame and placing said manhole cover onto said integral flange comprise:

placing ribbons cut from sheets of flexible material on a level surface;

placing said venting structure onto said ribbons;

placing said manhole cover onto said venting structure;

lifting said venting structure and manhole cover;

positioning said venting structure and manhole cover over said manhole frame; and lowering said venting structure and manhole cover onto said manhole frame;

wherein said ribbons are used as handles for lifting, positioning and lowering said venting structure and manhole cover as a single assembly.

21. The method of claim 13 further comprising:

inspecting said assembly to determine that said manhole cover is securely seated within said manhole frame so that said manhole cover does not move under normal traffic conditions and that said manhole cover substantially conforms to surface grade;

removing said manhole cover and said venting structure from said manhole frame;

placing a seal element onto said integral flange;

placing said venting structure onto said integral flange; and placing said manhole cover onto said integral flange so that said venting structure is held securely against said manhole frame by the weight of said manhole cover.

22. The method of claim 13 wherein said liquid-repellent gas-permeable material is a non-woven synthetic fabric selected from the group consisting of spun-bonded high-density polyethylene, spun-bonded polypropylene, spun-bonded polyester, spun-bonded polyacrylic, spun-bonded polyaramid, and expanded polytetrafluoroethylene fabrics, and laminates and composites thereof with other members of the group, and laminates and composites thereof with woven fabric.

23. The method of claim 13 wherein said liquid-repellent gas-permeable material is a water-proofed woven fabric selected from the group consisting of nylon, polyester, polyacrylic, polyaramid, and blends thereof.

* * * * *